US007637199B2

(12) United States Patent
Fluhr et al.

(10) Patent No.: US 7,637,199 B2
(45) Date of Patent: Dec. 29, 2009

(54) GAS CYLINDER COMPONENTS FOR USE WITH FIREARMS

(75) Inventors: Norbert Fluhr, Oberndorf (DE); Klaus Munst, Harthausen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 12/048,014

(22) Filed: Mar. 13, 2008

(65) Prior Publication Data

US 2009/0007478 A1 Jan. 8, 2009

Related U.S. Application Data

(63) Continuation of application No. PCT/EP2006/008883, filed on Sep. 12, 2006.

(30) Foreign Application Priority Data

Sep. 13, 2005 (DE) ..... 10 2005 043 653

(51) Int. Cl.
*F41A 5/00* (2006.01)

(52) U.S. Cl. ..... 89/193; 89/191.01; 89/191.02

(58) Field of Classification Search ..... 89/191.01, 89/191.02, 193
See application file for complete search history.

(56) References Cited

U.S. PATENT DOCUMENTS 1,333,498 A * 3/1920 Lang ..... 89/141
1,350,961 A * 8/1920 Farquhar et al. ..... 89/142
2,058,897 A * 10/1936 Marek ..... 89/193

(Continued)

FOREIGN PATENT DOCUMENTS

DE 1453904 9/1969

(Continued)

OTHER PUBLICATIONS

International Searching Authority, "International Search Report", for counterpart PCT application Serial No. PCT/EP2006/008883, mailed Dec. 6, 2006 (6 pages).

(Continued)

*Primary Examiner*—Stephen M Johnson
*Assistant Examiner*—Samir Abdosh
(74) *Attorney, Agent, or Firm*—Hanley, Flight and Zimmerman, LLC

(57) ABSTRACT

Methods and apparatus are described for gas cylinder components for use with a firearm with a barrel. The gas cylinder component includes a reception bore for receiving the barrel. Additionally, the gas cylinder component includes a torque-proof fixture that is under pre-stressing, wherein the torque-proof fixture comprises one or more bores tangential to the barrel further including a pin to create spring pinning action. Further, the gas cylinder component includes a foresight that is rotatable around an axis, and a demountable clamping device that secures at least one position of the foresight. The gas cylinder component is under spring pre-stressing and is torque proof on the barrel. Additionally, the gas cylinder component is to lock on the barrel. Further, the engagement of the gas cylinder component on the barrel is to substantially prevent the rotation of the gas cylinder apparatus relative to an axis of the barrel. Further yet, substantially all forces that are introduced to a front of the firearm is absorbed by the gas cylinder component and introduced into the barrel.

17 Claims, 3 Drawing Sheets

U.S. PATENT DOCUMENTS

| | | | | | |
|---|---|---|---|---|---|
| 3,323,418 | A | * | 6/1967 | Loffler | 89/193 |
| 3,330,183 | A | * | 7/1967 | Loffler | 89/193 |
| 3,333,509 | A | * | 8/1967 | Muhlemann | 89/193 |
| 3,359,860 | A | * | 12/1967 | Muhlemann | 89/193 |
| 3,618,457 | A | * | 11/1971 | Miller | 89/185 |
| 3,893,370 | A | * | 7/1975 | Hutton et al. | 89/193 |
| 4,693,170 | A | * | 9/1987 | Atchisson | 89/149 |
| 6,868,770 | B2 | * | 3/2005 | Cornils | 89/193 |
| 7,467,581 | B2 | * | 12/2008 | Botty | 89/193 |
| 2004/0237766 | A1 | * | 12/2004 | Cornils | 89/193 |
| 2007/0199435 | A1 | * | 8/2007 | Hochstrate et al. | 89/191.02 |
| 2008/0307954 | A1 | * | 12/2008 | Fluhr et al. | 89/193 |

FOREIGN PATENT DOCUMENTS

| | | |
|---|---|---|
| DE | 2932710 | 3/1981 |
| DE | 10318828 | 11/2004 |
| GB | 474685 | 11/1937 |
| WO | 2005121686 | 12/2005 |

OTHER PUBLICATIONS

International Searching Authority, "Written Decision", for counterpart PCT application Serial No. PCT/EP2006/008883, mailed Dec. 6, 2006 (5 pages with 5 page translation).

International Searching Authority, "International Provisional Report on Patentability", for counterpart PCT application Serial No. PCT/EP2006/008883, mailed Dec. 18, 2007 (12 pages including 4 page translation).

Patent Cooperation Treaty, "International Preliminary Report on Patentability", issued by the International Bureau in connection with counterpart PCT application Serial No. PCT/EP2006/008883, mailed Jul. 17, 2008 (7 pages).

* cited by examiner

GAS CYLINDER COMPONENTS FOR USE WITH FIREARMS

RELATED APPLICATION

This application is a continuation of International Patent Application Ser. No. PCT/EP2006/008883, filed on Sep. 12, 2006, which claims priority to German Patent Application 10 2005 043 653.6, filed on Sep. 13, 2005, both of which are hereby incorporated herein by reference in their entireties.

FIELD OF THE DISCLOSURE

The disclosure relates generally to gas cylinder components and more specifically to gas cylinder components for use with firearms.

BACKGROUND

Typically, modern semi-automatic and automatic weapons include a gas tube and/or a gas cylinder part that is used in cycling the firearm (e.g., ejecting a fired cartridge and inserting a new cartridge). For instance, DE 1 453 904 A, U.S. Pat. No. 1,350,961, DE 103 18 828 A1, and DE 29 32 710 A1, describe gas cylinder parts for use with firearms. The gas cylinder is typically positioned above the barrel so not to interfere with the magazine (e.g., the mechanism for supplying cartridges to the weapon). The position of the gas cylinder, which is just below a shooter's line of sight, allows for a recoil of the firearm to proceed in the direction of the shooter's shoulder and not above it, which has been the general rule for rifles (e.g., military and/or hunting rifles) from the beginning of the twentieth century.

The gas cylinder of automatic rifles, such as, for example, the AK 74, is not mounted on the muzzle. However, the sight base is coupled to the muzzle and the shooter typically wants to retain a line of sight as long as possible. It is difficult to mount the sight base to the muzzle because the sight base must not wobble and must absorb a heavy blow from, for example, firing and/or cycling the weapon, without displacing or bending. The gas cylinder is securely coupled to the barrel, but has certain tolerances as long as the bores in the barrel and in the gas cylinder meet, which is why one of the bores in the barrel or in the gas cylinder is typically larger than the other.

Additionally, automatic rifles include fixtures for coupling a hand guard, and/or grenade launcher to the rifle. The hand guard has to be parallel to the line of sight if fixtures for accessory devices are to be coupled to the hand guard, such as, for example, a Picatinny rail.

In some instances, if additional optical and/or electronic sighting mechanism(s) are used, the line of sight of the optical and/or electronic sighting mechanism(s) may not be anatomically designed for the rifleman, and, therefore, may not be used optimally. Collapsible sights are known that free the line of sight by tilting the sight, such as, for example, Swiss assault rifle 57, however, these sights have to be tilted upwards every time prior to using the rifle, and, thus, additional time is needed if the shooter does not want to take an unaimed shot.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The example gas cylinder component may be used with any suitable firearm or weapon, such as, for example, hunting rifles, semi-automatic firearms, automatic firearms, pistols and/or rifles. Additionally, the gas cylinder component is mountable on the firearm or weapon in a position that is sufficiently precisely reproducible.

Figure 1:
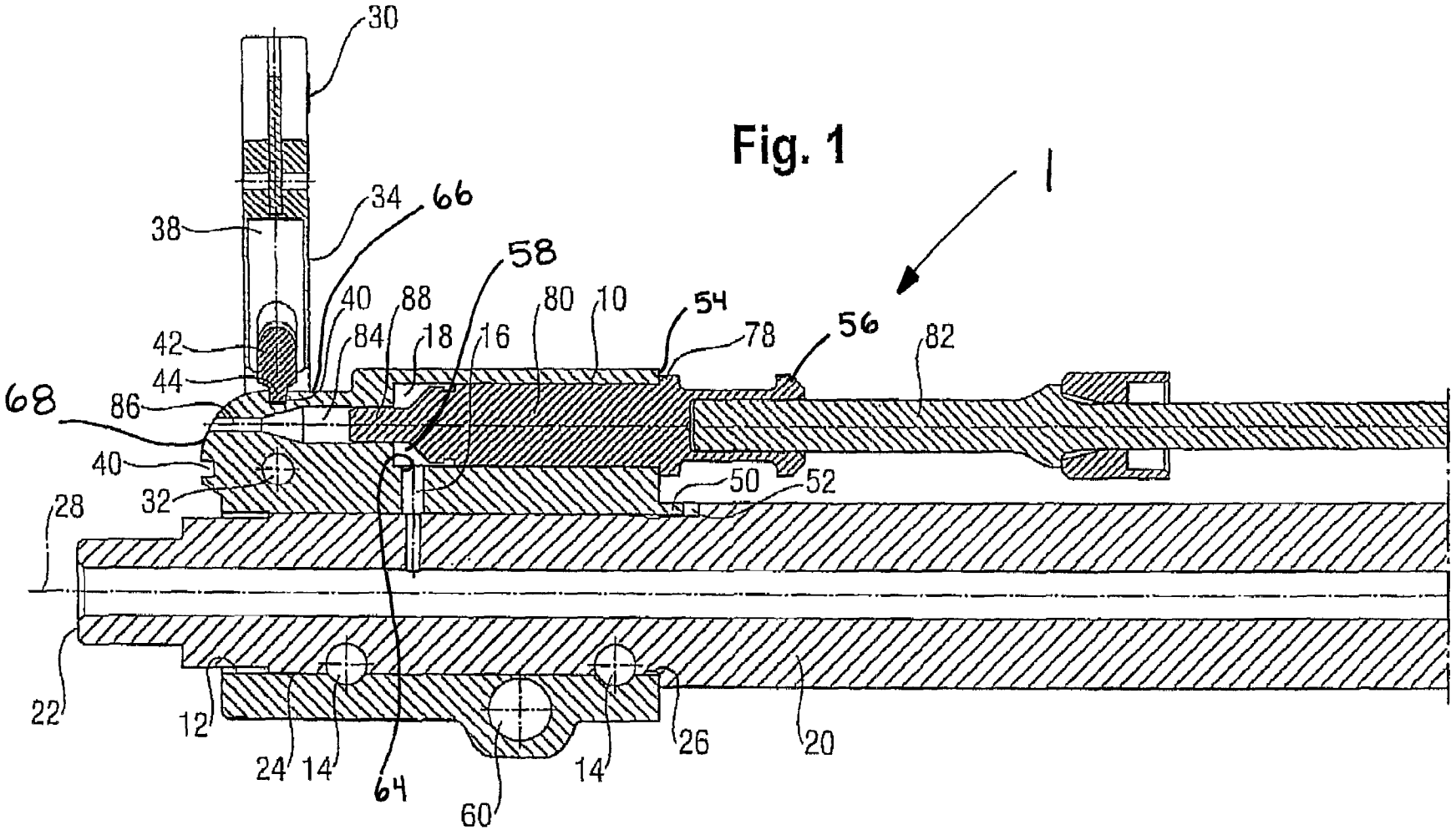
FIG. 1 is an enlarged partial cross-sectional view of an example short firearm.
Figure 2:
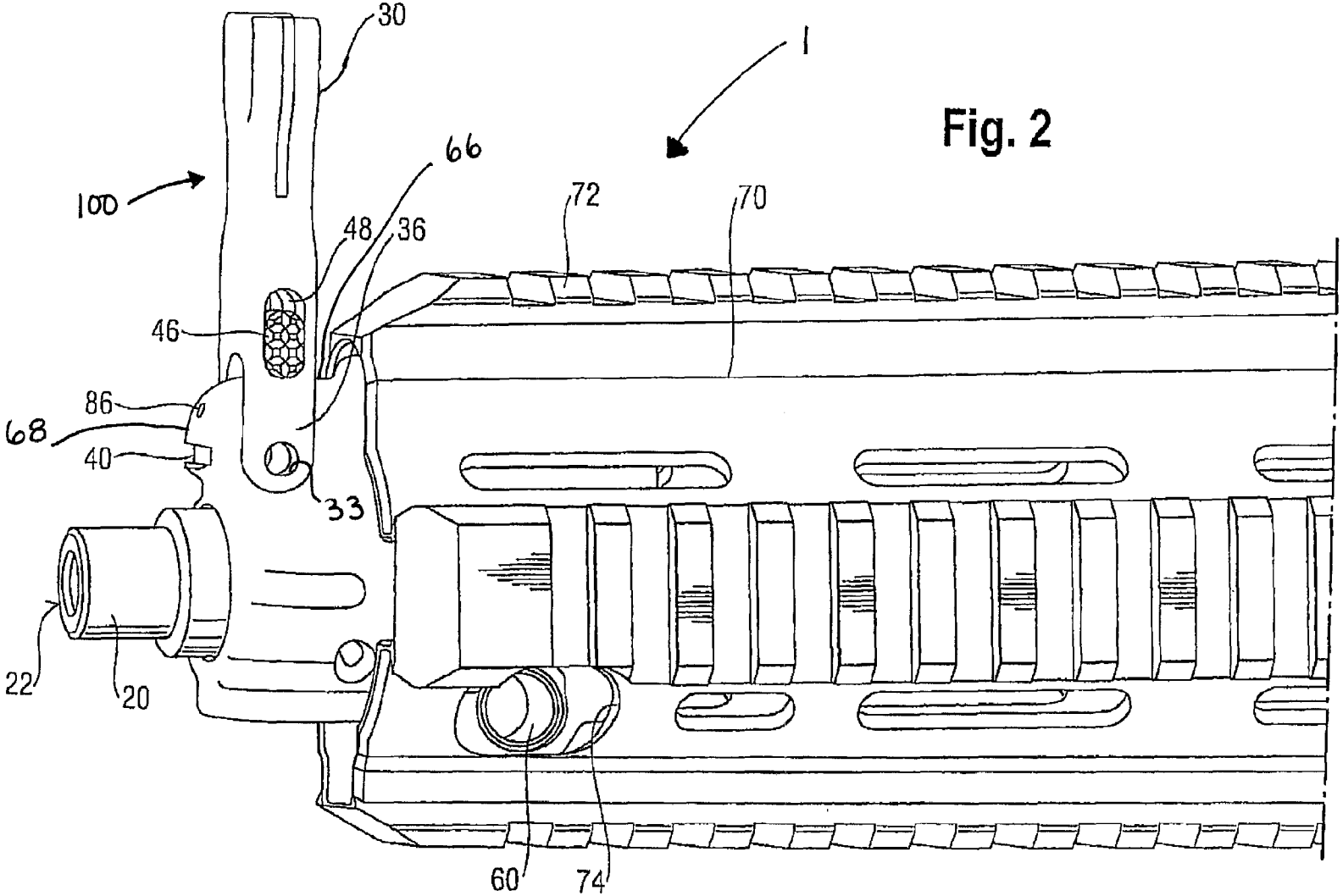
FIG. 2 is an enlarged partial perspective view of the short firearm of FIG. 1 with an example hand guard.

The example of FIGS. 1 and 2 illustrate an example short rifle 1 that includes an end 22 (e.g., a muzzle) of a barrel 20 that is near a front end of a hand guard 70 (FIG. 2) and before an example gas cylinder component 10. In this example, the end 22 of the barrel 20 and the gas cylinder component 10 protrude slightly from hand guard 70 (FIG. 2).

In this example, the gas cylinder 10 is coupled to the rifle 1 by sliding the gas cylinder component 10 over the end 22 of the barrel 20 so that a reception bore 12 of the gas cylinder component 10 engages an adaptive section 24. The diameter of the reception bore 12 may have a narrow transition that creates, for example, a force fit.

In this example, a section 26, that is annular (e.g., in the shape of a ring), is positioned on the end of the adaptive section 24 and is interrupted by a groove 52 in the barrel 20. The gas cylinder component 10 is positioned on the section 26 and is rotationally coupled to the barrel 20 via a journal 50 that engages the groove 52 such that the gas cylinder component 10 does not rotate around an axis 28 of the barrel 20 and/or is substantially torque proof. The journal 50 is integrally coupled to the rear of the gas cylinder 10, and the groove 52 is positioned on the upper side of the barrel 20. Additionally, the gas cylinder component 10 includes a plurality of transverse bores 14 that are positioned below the barrel 20 into which a spring pin (not shown) or any other suitable device is inserted into (e.g., hammered into) from the outside. Any number of transverse bores (e.g., 1, 3, 4, etc.) may be used with any number of spring pins (e.g., 1, 3, 4, etc.). The spring pins may be pre-stressed and may pre-stress the gas cylinder component 10 when inserted into the transverse bores 14 to create spring pinning action.

In this example, the gas cylinder component 10 is substantially torque proof around the axis 28 of the barrel 20 during for example, unusual external forces, due to the spring pins and the transverse bores 14, the journal 50 and the groove 53, the engagement of the bore 12 of the gas cylinder component 10 and the adaptive section 24, and/or the positioning of the gas cylinder component 10 on the section 26. The position of the barrel 20 relative to the gas cylinder component 10 is substantially the same even after multiple assemblies and disassemblies of the firearm 1.

In this example, the barrel 20 and the gas cylinder component 10 define a gas relief bore 16 that is transverse to the bore axis 28. The gas relief bore 16 leads to a gas cylinder bore 18 that is substantially parallel to the bore axis 28 and defines an opening 54 at an end of the gas relief bore 16. A gas piston 80, that is movable (e.g., forwards and/or backwards), is received by the gas cylinder component 10 and receives a gas rod 82 at an end 56. Additionally, the gas cylinder component 10 includes a release bore 84 that is coaxial and fluidly coupled with the gas cylinder bore 18 and is in front of the gas piston 80. Additionally, the release bore 84 receives a gate valve 88 that is integrally constructed with the gas piston 80. Further, the gate valve 88 occupies (e.g., penetrates) the area in the gas cylinder bore 18 where the gas piston 80 is not positioned (e.g., an empty space 58). The size of the empty space 58 varies depending on, for example, the position of the gas piston 80 within the gas cylinder bore 18. The gas piston 80 includes a collar 78 that, in a rest position, engages an edge of the opening 54 that substantially stops additional forward travel of the gas piston 80 within the gas cylinder bore 18. The gas relief bore 16 includes an opening 64 defined by the gas cylinder component 10 that is substantially next to the empty space 58.

In this example, the release bore 84 tapers toward a gas nozzle 86 that leads to the ambient air (e.g., outside air) and is positioned above the barrel 20 and at the front of the gas cylinder component 10. In other examples, the gas nozzle 86 and/or the release bore 84 may be positioned in any other suitable position.

In this example, during firing, a projectile (not shown) is fired through the barrel 20 and increases gas pressure (e.g., a high gas pressure) within the barrel 20. At least some of the high pressure gas travels through the gas relief bore 16 into the gas cylinder bore 18 and moves the gas piston 80 backwards (e.g., towards the rear of the rifle 1). The gate valve 88, that is integrally coupled to the gas piston 80, moves backwards with the gas piston 80 until the gate valve 88 is at least partially removed from the rear of the release bore 84. At this position of the gas piston 80, the empty space 58 may be at a maximum size. When the gate valve 88 is removed from the release bore 84, the relatively high pressure gas is able to escape (e.g., exit) through the release bore 84 and the gas nozzle 86 to the ambient air. Releasing the relatively high pressure gas through the gas nozzle 86 may reduce the contamination of the gas rod 82 and/or may reduce the amount of dirt that is exposed to gas rod 82 from the gas.

In this example, the gas cylinder component 10 surrounds the barrel 20. The section of the gas cylinder component 10 above the gas nozzle 86 and a portion of the release bore 84 is smaller relative to other portions of the gas cylinder component 10 and includes a flat section 66. The gas cylinder component 10 defines a hinge bore 32 that is positioned between the transition of the release bore 84 and the gas nozzle 86 and the barrel 20.

The example of FIG. 2 illustrates a foresight base 34 that includes two legs 36 that surround the flat section 66 of the gas cylinder component 10. The two legs 36 straddle over the front part of the flat section 66. The hinge bore 32 (FIG. 1) aligns with a bore 33 defined by the foresight base 34 into which a hinge pin (not shown) is inserted into. The hinge pin is coupled to the two legs 36 and/or the gas cylinder component 10, however, the hinge pin is able to the rotate within the two legs 36 and/or the gas cylinder component 10. In this example, the front of the gas cylinder component 10 is constructed to allow the foresight base 34 to rotate about the hinge pin between a vertical position and a horizontal position (not shown).

Turning back to the example of FIG. 1, the gas cylinder component 10 includes a plurality of transverse grooves 40 that correspond to the vertical and the horizontal positions of the foresight 34. The foresight 34 defines a blind hole 38 that is positioned between the two legs 36 (FIG. 2) and is near the bottom of the foresight base 34. A slider 42 is positioned between the two legs 36 and a compression spring (not shown) is positioned between the slider 42 and the blind hole 38. The compression spring presses the slider 42 downward. A cross rib 44 may be integrally constructed with or coupled to the slider 42 (e.g., the underside of the slider 42). The cross rib 44 and/or the transverse groove 40 may be slightly conical and taper towards the seat of the cross rib 44 and/or the base of the groove 40 so that the compression spring presses the cross rib 44 into the corresponding groove 40 to firmly engage the interior surface of the transverse grooves 40 with the exterior surface of the cross rib 44. In other examples, the cross rib 44 and/or the groove 40 may be any suitable shape and/or size. In this example, the top of the cross rib 44 does not engage the base of the corresponding groove 40.

In this example, to move a foresight 30 between the horizontal and the vertical position, the cross rib 44 can be disengaged from the groove 40 by lifting the slider 42 via the handle 46. After the slider 42 disengages one of the grooves 40, the slider 42 rubs and/or engages a front surface 68 of the gas cylinder component 10 as the slider 42 moves between positions (e.g., the horizontal position and the vertical position) before the slider 42 engages a different groove 40. The front surface 68 is smooth and/or a circular arch-shape and the hinge bore 32 is the central axis.

Turning now to the example of FIG. 2, the two legs 36 each define a window 48 (FIG. 2) where a handle 46 may be positioned that is coupled to the slider 42. The slider 42 can be inserted and/or slid into the blind hole 38 without wobbling.

In this example, the sight 100 includes the foresight 30 and the foresight base 36 that can be moved from the vertical position to the horizontal position with the handle 46 for any suitable reason, such as, for example, to slide an accessory device onto a Picatinny rail 72 on the upper side of a hand guard 70 and/or to slide the hand guard 70 off of the rifle 1 from the front. The fitting bore 60 may be positioned in any other suitable position and the hand guard 70 may not include the clearance 74.

In the example, the gas cylinder component 10 defines a fitting bore 60 that is below the barrel 20 where any suitable additional item (e.g., accessory device) may be attached, such as, for example, tripod, a carriage, a grenade launcher (e.g., a mortar launcher), and/or an infrared headlight. The hand guard 70 defines a clearance 74 near the fitting bore that may minimize the difficulty of attaching and/or coupling the accessory devices.

Figure 3:
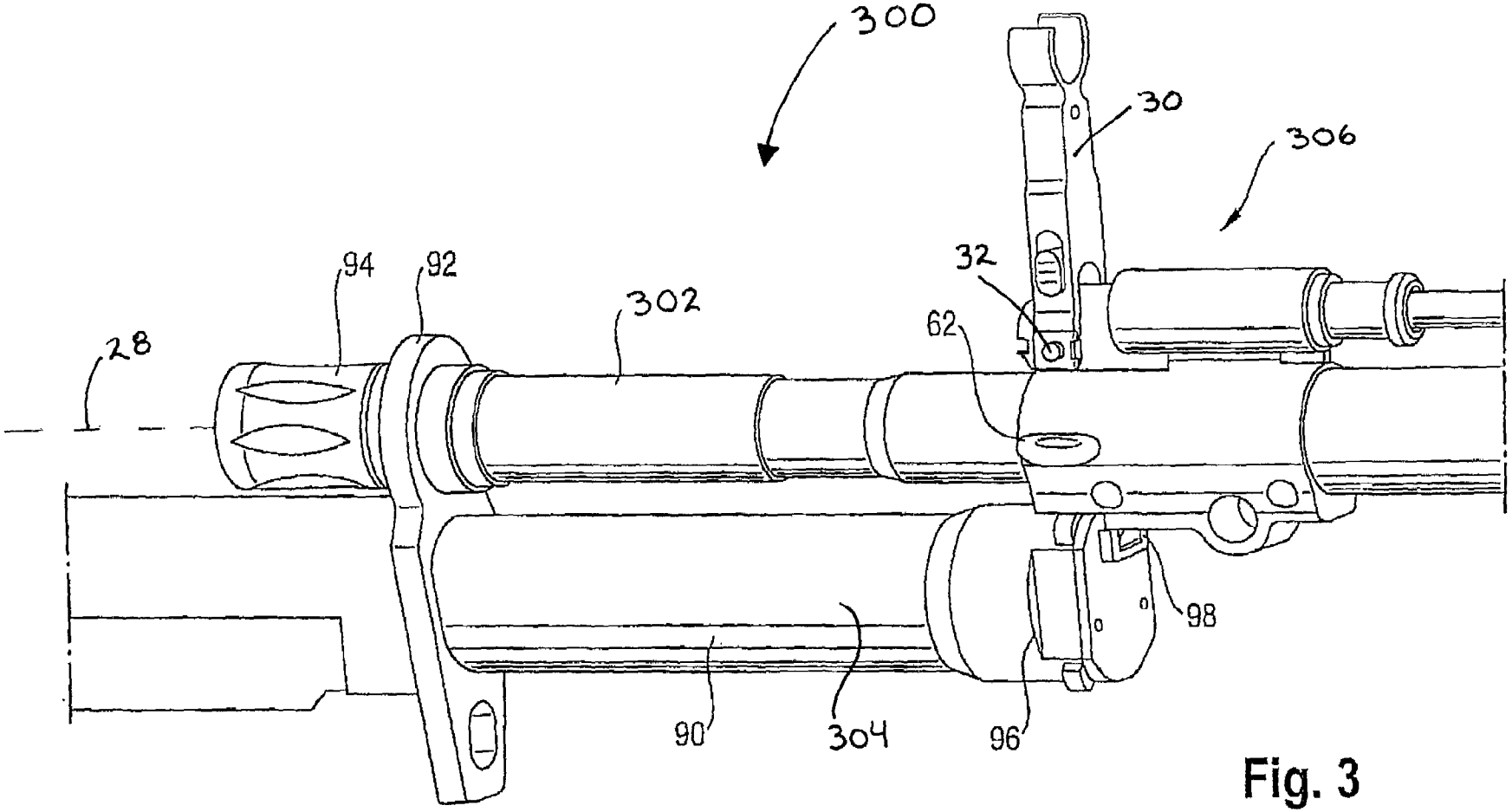
FIG. 3 is an enlarged partial perspective view of an alternative example firearm.

The example of FIG. 3 illustrates an alternative rifle 300 that has a larger length as compared to the short rifle 100 of FIGS. 1 and 2. The example gas cylinder component 306 of FIG. 3 may include a structure similar to the structure described above in the example gas cylinder component 10 of FIGS. 1 and 2, and those similarities will not be repeated. The rifle 300 includes a barrel 302 that extends farther from the gas cylinder component 306 as compared to the barrel 20 of FIGS. 1 and 2. The hand guard is not shown in FIG. 3, however, the hand guard, may be substantially the same as the hand guard 70 of FIG. 2.

In this example, a flash hider 94 is coupled to the end of the barrel 302 and may diminish and/or distribute the muzzle flash and/or protect the muzzle (not shown in FIG. 3). The rifle 300 includes a holding rail 98 that is positioned on the under side of the gas cylinder component 10 under the barrel 302.

In this example, a bayonet 90 includes a fixture 92 and a retaining groove 96 at an end of a handle 304 that is complimentary to the holding rail 98 of the gas cylinder component 10. To install the bayonet 90 on the rifle 300, the fixture 92 is slid from the front over the flash hider 94 and the retaining groove 96 engages the holding rail 98. Additionally, a slider (not shown) near the rear of the bayonet 90 engages a groove (not shown) in the holding rail 98 via, for example, a spring. A fixture 62 is positioned on both sides of the gas cylinder component 10.

In this example, the forces that may be introduced into the front part of the rifle 300 are absorbed by the gas cylinder component 306 and the barrel 302. In some examples, the fixture 92 may introduce forces into the barrel 20 via the flash hider 94.

The disclosure relates to a gas cylinder component 10 and a hand guard 70 for use with firearms that is reliable and relatively inexpensive. In this example, the gas cylinder component 10, 306 engage the barrel 20, 302 and prevents rotation of the barrel 20, 302 relative to the barrel axis 28. Additionally, the gas cylinder component 10, 306 is substantially torque-proof on the barrel 20, 302 and may be pre-stressed and/or spring pre-stressed. Further, the foresight 30 is movable (e.g., collapsible) around an axis of the hinge bore 32 of the gas cylinder component 10, 306. A demountable clamping device (e.g., the grooves 40, the slider 42, and the cross rib 44) assist the foresight 30 in maintaining a position (e.g., the vertical position and/or the horizontal position). The gas cylinder component 10, 306 includes a torque proof fixture under pre-stressing that may include the transverse bores 14. Additionally, forces that may be introduced to the front of the rifle 1, 300 are substantially absorbed by the gas cylinder, 306 and are introduced to the barrel 20, 302.

In some examples, the transverse bores 14 include two spring pins (e.g., roll pins) that are positioned tangent to the barrel 20, 302 and are pre-stressed in the radial direction.

In these examples, the gas cylinder component 10, 306 is coupled to the barrel 20, 302 via spring pins, via the reception bore 12 of the gas cylinder component 10, 306 engaging the adaptive section 26 of the barrel 20 and/or via the journal 50 engaging in a corresponding groove 52 on the outside of the barrel 20, 302. The journal 50 may be integrally coupled to the gas cylinder component 10. The engagement of the journal 50 and the corresponding groove 52 substantially prevents rotation of the gas cylinder component 10, 306 and may allow for the gas cylinder component 10, 306 to be able to absorb impact forces that may occur, such as, for example, when the rifle falls down, without moving out of position. The position of the gas cylinder component 10, 306 relative to the barrel 20, 302 may be maintained even if the transverse bores 14 for the spring pins are imprecise.

In some examples, the demountable clamping device assists the foresight 30 to be in the vertical position (e.g., the use position, the upright position) and/or the horizontal position, and may reduce wear and tear on the foresight 30.

As discussed above, the spring pins may prevent the gas cylinder component 10, 306 from working itself loose during, for example, operating conditions. In some examples, the spring pins may be tangential roll pins that may pre-stress the gas cylinder component 10, 306 and at least partially prevent the gas cylinder component 10, 306 from rotating and/or prevent the gas cylinder component 10, 306 from moving forward. The spring pins and/or the gas cylinder component 10, 306 may be capable of absorbing considerable forces. In some examples, the spring pins are slotted hollow pins from sheets that are pressed into the transverse bores 14, and, are thus, pressed together. Additionally, the spring pins may be pre-stressed in the radial direction.

As described above, the foresight 30 can be tilted (e.g., rotated) around the hinge bore 32 axis. Additionally, the hinge bore 32 is the location in which the foresight 30 is coupled to the gas cylinder component 10, 306. Additionally, the foresight 30 includes a slider 42 that is positioned between the two legs 36 that is movable in the longitudinal direction relative to the foresight 30. The slider 42 includes a cross rib 44 that engages the groove 40 to position the foresight 30, for example, in the vertical position and/or the horizontal position. The grooves 40 are associated with the foresight 30 being positioned in the horizontal position and the vertical position. In other examples, the gas cylinder component includes additional (3, 4, etc.) grooves 40 that are associated with different foresight 30 positions. Alternatively, only one groove 40 may be provided on the gas cylinder component 10, 306 that may be associated with the vertical position.

In some examples, the groove 40 is complementary to the cross rib 44, however, the cross rib 44 may not engage the bottom of the groove 40 because the depth of the groove 40 is larger than the cross rib 44. The size of the cross rib 44 relative to the depth of the groove 40 may allow for the cross rib 44 to be pressed deeply into the groove 40 to be fixed in and/or engage the groove 40 even if, for example, wear and tear occurs and/or the cross rib 44 and/or the groove 40 is improperly manufactured (e.g., imprecisely manufactured, manufacturing defect). The spring positioned between the slider 42 and the empty space 38 presses the cross rib 44 into the groove 40 and creates a force in the foresight base 34 (e.g., an upwards force) that may minimize radial play and/or movement of the foresight base 34. The groove 40 has a wedge-shaped cross section. In other examples, the groove 40 may have any other suitable cross-section.

As discussed above, the slider 42 includes a handle 46 that may be used to disengage the cross rib 44 from the groove 40. In other examples, the cross rib 44 may be disengaged from the groove 40 with any suitable tool, such as, for example a screw driver. The foresight 30 may be tiltable (e.g., movable) and/or collapsible without the need of additional components to, for example, move the foresight 30 out of the line of sight of another device (e.g., an additional sighting device). In some examples, the additional sighting device may use an ideal optical axis if the foresight 30 is in the horizontal position. Alternatively, the foresight 30 may use the ideal optical axis if an additional sighting device is not used and the foresight is in the vertical position.

As described above, an accessory device may be slid onto the Picatinny rail 72 by moving (e.g., rotating) the foresight 30 into the horizontal position. The hand guard 70 may be made of one piece of material and may be removed from the front of the rifle 1 by rotating the foresight 30 into the horizontal position and unlocking and sliding the hand guard 70 forward. In other examples, the hand guard 70 may be made of two or more pieces of materials.

In some examples, the gas cylinder component 10, 306 includes a groove 40 on the front of the gas cylinder component 10 into which the cross rib 44 of the slider 42 can engage in the horizontal position. The groove 40 that is associated with the horizontal position may ensure that the foresight 30 does not accidentally come into the line of sight and/or may minimize the damage and/or wear on the foresight 30 by fixing the foresight 30 in a position. In other examples, the gas cylinder component 10, 306 does not have a groove 40 that is associated with the foresight 30 horizontal position.

As discussed above, the gas cylinder component 10, 306 includes the fitting bore 60 where additional items, such as, for example, accessory devices, a hand guard, may be coupled to and/or attached to. Because the gas cylinder component 10, 306 is rotationally coupled to the rifle 1, the gas cylinder component 10, 306 may be used to attach additional items in a predefined position, such as, for example, the hand guard 70 that includes the Picatinny rail 70 onto which, for example, an additional sighting mechanism can be attached because the position of the barrel axis 28 relative to the hand guard 70 is would be substantially consistent. In some examples, a tripod or a grenade launcher may be coupled to the fitting bore 60.

As described above, the gas cylinder component 10, 306 includes the fixture 62 on both sides that may be used to attach, for example, a neck strap or shooting sling. In other examples, the gas cylinder component 10, 306 may include one fixture 62 or may not include a fixture 60 at all. The forces that are introduced to the front of the rifle 1, 300 may be introduced without an additional absorbing element. In some examples, a rifle housing (not shown) is made of plastic and can only absorb limited forces.

In some examples, the gas cylinder component 10, 306 includes the holding rail 98 that may be integrally coupled to the gas cylinder component 10, 306. The holding rail 98 is coupled directly to the barrel 20, 302 via the gas cylinder component 10, 306. Historically, the bayonet has not been supported by the barrel.

As discussed above, the gas cylinder component and/or the hand guard may be used with type of suitable firearm, such as, for example, a hand guard, an assault weapon, an automatic weapon.

Furthermore, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A gas cylinder component for use with a firearm with a barrel, the gas cylinder component comprising:

a reception bore for receiving the barrel;

one or more externally accessible bores tangential to the barrel each to receive a spring pin having an elongated body that is pre-stressed in the radial direction to create spring pinning action and to urge the gas cylinder component against the barrel;

a foresight that is rotatable around an axis; and a demountable clamping device that secures at least one position of the foresight;

wherein the gas cylinder component is torque proof on the barrel and is to lock on the barrel; and wherein the engagement of the gas cylinder component on the barrel is to substantially prevent the rotation of the gas cylinder component relative to an axis of the barrel.

2. The gas cylinder component as defined in claim 1, wherein the foresight further includes a foresight base that is coupled to the gas cylinder component.

3. The gas cylinder component as defined in claim 1, wherein the foresight houses a longitudinally movable spring loaded slider.

4. The gas cylinder component as defined in claim 1, wherein accessory devices are coupled to the fitting bore.

5. The gas cylinder component as defined in claim 1, further comprising at least one fixture to couple at least one of a neck strap or a shooting sling.

6. The gas cylinder component as defined in claim 1, further comprising an integrally coupled bayonet fixture.

7. The gas cylinder component as defined in claim 1, wherein the reception bore is tapered.

8. A gas cylinder component for use with a firearm with a barrel, the gas cylinder component comprising:

a reception bore for receiving the barrel;

a torque-proof fixture that is under pre-stressing, wherein the torque-proof fixture comprises one or more bores tangential to the barrel further including a pin to create spring pinning action, wherein the gas cylinder component is under spring pre-stressing and is torque proof on the barrel and wherein the gas cylinder component is to lock on the barrel and is to substantially prevent the rotation of the gas cylinder component relative to an axis of the barrel; and a foresight that is rotatable around an axis, wherein the foresight comprises a longitudinally movable spring loaded slider that engages a groove of the gas cylinder component to secure at least one position of the foresight.

9. The gas cylinder component as defined in claim 8, wherein the groove is associated with a vertical position of the foresight.

10. The gas cylinder component as defined in claim 8, wherein the slider further comprises a handle.

11. The gas cylinder component as defined in claim 8, wherein the slider engages a second groove on the gas cylinder component.

12. The gas cylinder component as defined in claim 11, wherein the second groove is associated with a horizontal position of the foresight.

13. A method of attaching a gas cylinder component to a weapon having a barrel, comprising:

sliding a gas cylinder component over the barrel;

engaging a surface of the gas cylinder component with an adaptive section of the barrel;

engaging a journal of the gas cylinder component with a groove on the barrel; and pre-stressing the gas cylinder component by inserting at least one spring pin into a tangential bore defined by the gas cylinder component to create spring pinning action.

14. The method as defined in claim 13, further comprising rotating a foresight around the gas cylinder component between a vertical position and a horizontal position.

15. The method as defined in claim 14, further comprising disengaging a slider from a groove of the gas cylinder component, wherein the slider is encased in the foresight.

16. The method as defined in claim 13, further comprising fixing a foresight in a position.

17. The method as defined in claim 13, wherein the gas cylinder component further comprising absorbing forces introduced to a front of the weapon.

* * * * *